US006675398B1

(12) United States Patent
Antunez

(10) Patent No.: US 6,675,398 B1
(45) Date of Patent: Jan. 13, 2004

(54) DIVERTER FOR USE WITH TANK VALVES TO DIRECT FLOW TO TANK OR RIM

(76) Inventor: Bruce A. Antunez, 1143 Indian Springs, Glendora, CA (US) 91740

( * ) Notice: Subject to any disclaimer, the term of this patent is extended or adjusted under 35 U.S.C. 154(b) by 0 days.

(21) Appl. No.: 10/306,817

(22) Filed: Nov. 26, 2002

(51) Int. Cl.[7] ..... E03D 1/36; F16K 31/18

(52) U.S. Cl. ..... 4/366; 4/331; 4/415; 137/391; 137/410; 137/423; 137/426; 137/436; 137/441; 137/874

(58) Field of Search ..... 4/331, 366, 367, 4/415; 137/319, 410, 423, 426, 436, 441, 5.48, 872, 874

(56) References Cited

U.S. PATENT DOCUMENTS

| | | | | | |
|---|---|---|---|---|---|
| 1,939,118 | A | * | 12/1933 | Hinsdale | 4/331 |
| 1,971,880 | A | * | 8/1934 | Taylor | 4/331 |
| 2,501,589 | A | * | 3/1950 | Teahen | 4/331 |
| 2,773,267 | A | * | 12/1956 | Kohlmeyer | 4/331 |
| 2,923,012 | A | * | 2/1960 | Kohlmeyer | 4/331 |
| 3,086,217 | A | * | 4/1963 | Barlow | 4/367 |
| 3,147,762 | A | * | 9/1964 | Ducey | 137/436 |
| 3,172,128 | A | * | 3/1965 | Ducey | 4/331 |
| 3,501,779 | A | * | 3/1970 | Ward | 4/331 |
| 3,516,094 | A | * | 6/1970 | Reagan | 137/436 |
| 4,318,194 | A | * | 3/1982 | Pinkston | 4/366 |
| 4,408,361 | A | * | 10/1983 | Rozek | 4/331 |
| 4,420,845 | A | | 12/1983 | Antunez | |
| 4,494,562 | A | | 1/1985 | Stephens | |
| 4,730,639 | A | | 3/1988 | Antunez | |
| 4,918,763 | A | * | 4/1990 | Brotcke | 4/331 |
| 4,996,726 | A | * | 3/1991 | Schrock et al. | 4/331 |
| 5,007,452 | A | | 4/1991 | Antunez | |
| 5,175,894 | A | * | 1/1993 | Chen | 4/331 |
| 5,579,542 | A | * | 12/1996 | Hayman | 4/415 |
| 5,862,538 | A | * | 1/1999 | Ho | 4/366 |
| 6,502,251 | B1 | * | 1/2003 | Teshima et al. | 4/300 |

* cited by examiner

*Primary Examiner*—George L. Walton
(74) *Attorney, Agent, or Firm*—Donald D. Mon

(57) ABSTRACT

A diverter valve for selectively passing water from a ballcock valve directly to a water storage tank or to the rim of a toilet. It includes a diverter plunger which places a deflector into the path of water from the ballcock, and a float which removes the deflector from the lumen when the ballcock valve is closed and the water level is sufficiently high, and lowers the plunger when the water level is sufficiently low.

4 Claims, 3 Drawing Sheets

DIVERTER FOR USE WITH TANK VALVES TO DIRECT FLOW TO TANK OR RIM

FIELD OF THE INVENTION

A diverter for use along with a toilet tank valve to direct water to the rim of a toilet bowl and then to refill the tank for storage of water to be used in the next flush.

BACKGROUND OF THE INVENTION

There are two classical flushing systems for toilet waste. In one, an off-on valve discharges water directly from its outlet port to the bowl, and the flushing operation continues as long as the valve remains open. These systems depend on a reliable source of water under pressure to provide the flushing action. It is a continuously pressurized system and can operate for as long as the valve is held open.

The other type of system utilizes water already stored in a tank for later release. It inherently cannot operate continuously. Its next activation must await refilling of a tank, which always requires a lull period between flushes while the tank is refilled. It does not depend for its next flush on a pressurized source of water. The water for it is already in the tank.

Simple tank valves (often called "ballcocks") are operated by a float whose condition is responsive to the water level in the tank. When there is a full tank, the float is high, and the valve is closed. When the tank water level is lower, the valve opens to refill the tank, and stays open until the water level again reaches the storage level.

This is only part of the system. There is a second valve in the system, the so-called flush valve. It fits in a discharge opening in the tank below the storage level. This valve is closed by pressure of the stored water until it is opened by being lifted by a linkage operated by a button or a handle mounted to the tank. It stays open until the water level reaches a lower level, and then closes by gravity or by a linkage. Then the tank can be refilled.

While the flush valve is open, it passes water from two sources: the stored water, and water from the tank valve which flows while the tank valve is open. For flushing purposes the flush valve passes stored water plus water passed by the tank valve while the flush valve is open.

This attends to the flushing away of waste in the bowl. There are two other functions involved. One is the washing of the bowl rim and wall, and the other is to provide water to seal the exit of the bowl against sewage gases.

Conventional systems generally provide as part of the ballcock valve two discharges- one to the tank and the other to the bowl. These are opened concurrently, the tank refill rate being a predetermined part of the total flow. Thus, while the ballcock valve is open, part of its discharge water does not flow into the tank, but into the bowl instead. These two flows are simultaneous.

The bowl refill water serves at first to wash the bowl in the same way the flow through the flush valve does. However, the later flow, after the flush valve closes but the tank valve stays open, continues to go to the bowl to seal the bowl- the bowl refill.

This assigns to the tank valve the two functions, each of which is compromised by being part of the combination. In addition, the tank valve itself must be more complicated, because it must be designed for a divided flow, and perhaps for an adjustably divided flow.

The rim wash (or bowl wash) can never be as strong a stream as would be preferred, because of the division of flow. Beyond that, water may be wasted because, while the tank is being refilled at an agreeable rate, excess water may be sent to the bowl. A simple tank valve to monitor the water level in the tank should not be burdened with the complexity necessary to provide an additional function.

It is an object of this invention to provide an elegantly simple diverter valve which will divert substantially all of the water from the tank valve to the rim of the bowl for a brief high rate discharge of water to wash waste to the bottom of the bowl, and then to shuttle to a position where substantially all of the water will go to the tank until the tank is refilled.

The discharge from the flush valve to the bowl will be such that after the siphoning action has been completed, sufficient water will remain without the need for a continuing supply from an open tank valve (which will be closed).

It is an object of this invention to provide a simple, separate valve to divert the flow from the tank valve for the brief initial burst to the rim of the bowl, and thereafter to direct all water to the tank.

BRIEF DESCRIPTION OF THE INVENTION

The diverter valve of this invention receives flow of water directly from the tank valve when the tank valve is open. It has no control function when the tank valve is closed. For example, it does not shut off flow, ever, but instead serves only to direct flow which it receives.

The diverter valve has a base which is fixed relative to the water tank in which it is installed. The base includes a through passage having an inlet port, an outlet port, and a lumen. A guide cylinder opens into the through passage and extends away from said through passage at an angle thereto, to an open end spaced from said through passage. It has an inside cylindrical wall.

A diverter plunger comprises a tubular shaft with an outer cylindrical wall that makes a close sliding fit with the inside wall of the guide cylinder. A flow passage extends from a first end of said plunger to a second end thereof. Said first end bears a deflector which, when located in said lumen of the through passage, obstructs said through passage and deflects flow of water into the flow passage in the tubular shaft.

The plunger is adapted to move such that its deflector can selectively be placed inside of and outside of said lumen.

A tank discharge tube is attached to said plunger in fluid communication with its passage, and is directed downwardly. A float is attached to said tank discharge tube below the level of said base, whereby to be buoyant when immersed in water to tend to raise said discharge tube and plunger, said plunger when receiving water from said tank valve with said diverter in said lumen, being dynamically held in said position regardless of the water level in the tank.

The above and other features of this invention will be fully understood from the following detailed description and the accompanying drawings, in which:

DETAILED DESCRIPTION OF THE INVENTION

Figure 2:
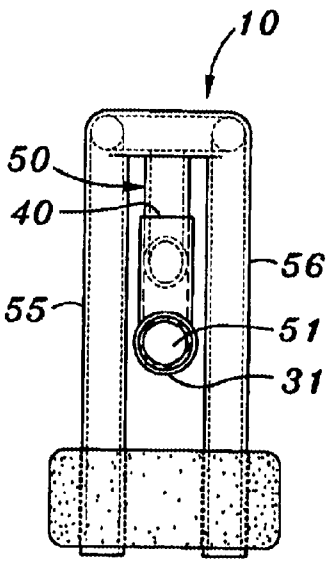
FIG. 2 is a cross-section taken at line 2—2 in FIG. 1.

The diverter valve 10 of this invention is for use in a water tank 11. The tank has a bottom 12, a peripheral sidewall 13 and an open top 14 usually closed by a removable lid.

Figure 3:
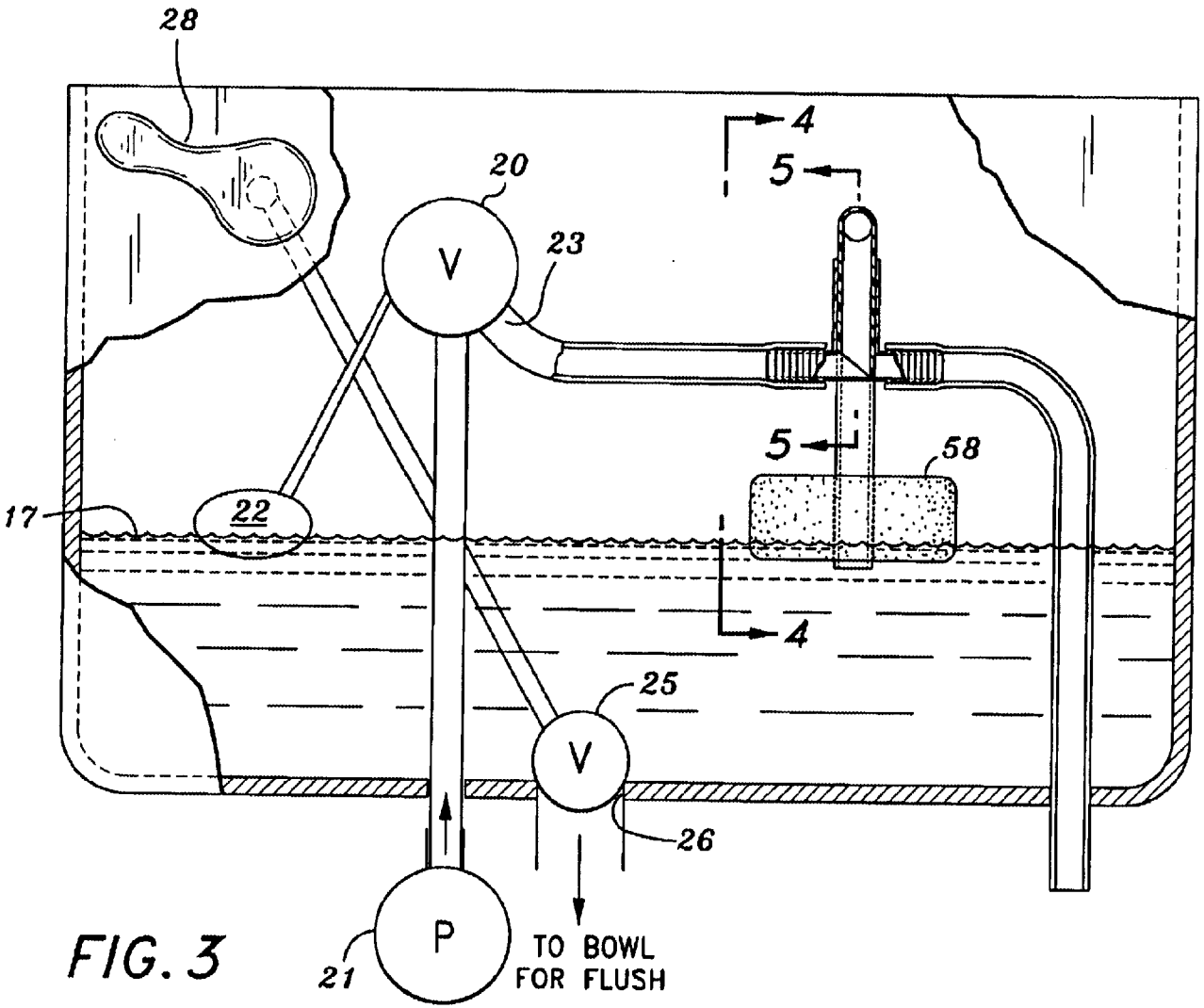
FIG. 3 is a side elevation as in FIG. 1, showing the system in its active flush and refill condition.

The tank holds water, which when stored stands at a storage level 16, the repose condition. When emptied, there will sometimes be water remaining in the tank, depending on the type of installation. Still, there will always be a lower level 17 (FIG. 3) which might be an empty tank or a tank still partially full, which exists just after a flush valve (to be described) closes.

In accordance with ordinary practice, a tank valve 20 (sometimes called a "ballcock") receives water under pressure from a supply 21. It includes a float 22, schematically shown, which floats on water in the tank and causes the tank valve to close when the water is at the storage level. Any suitable kind of tank valve may be used. An example is shown in Antunez U.S. Pat. No. 6,244,292, which is incorporated herein by reference for its showing of a useful valve.

When water is below the storage level, the float will follow its surface (or hang in the air), and cause the tank valve to open to resupply the tank until the water surface again is at the storage level. Water from the tank valve exits from exit port 23. The tank valve as used in this invention has a single outlet through which all water flows. There is no division of this flow at the tank valve.

Flushing is controlled by flush valve 25. This valve is fitted in a discharge opening 26 in the bottom of the tank, and discharges directly to the toilet bowl. This may be any of a wide array of well-known valves, for example, a flapper valve which pivots to close and remain closed when the contents are discharged from the tank, but when pulled open, remains buoyant while raised to permit water to flow from the tank. Any suitable type of flush valve may be used. Examples are Bruce Antunez U.S. Pat. Nos. 4,365,365 and 4,841,579, which are incorporated by reference for their showing of useful structures.

A handle 28 with a lever and lifting chain (schematically shown) is mounted to the wall of the tank to open the flush valve and start a cycle.

A diverter valve 10 according to this invention is fixed relative to the tank, inside the tank. It may be mounted to the tank, to structure attached to the tank, or even to the tank valve itself.

Diverter valve 10 has a base 31 which may conveniently be tubular. It has an inlet port 32, an outlet port 33, and a through passage 34 between ports 32 and 33. Port 32 is connected to exit port 23 of the tank valve. Port 33 is connected to a rim wash line 35 which discharges to the bowl, preferably along the rim to wash the rim and wall while water from the flush valve flows directly into the bowl to flush the solids away.

A guide cylinder 40 rises from base 31. It has a central axis 41 which will be oriented vertically, or close to vertically. Through passage 34 has a flow axis 42 which usually will be at a right angle to axis 41, and therefore horizontal. Guide cylinder 40 has an internal axially-extending cylindrical wall 43 from a first end 45 where it intersects and opens into the through passage to a second upper end 46.

A tubular diverter plunger 50 has an outer wall which makes a close sliding fit in wall 43 so it can move axially in the guide cylinder, relative to the base. The flow passage, at the intersection of the guide cylinder, has a lumen 51 which is a lateral cross-section.

Figure 6:
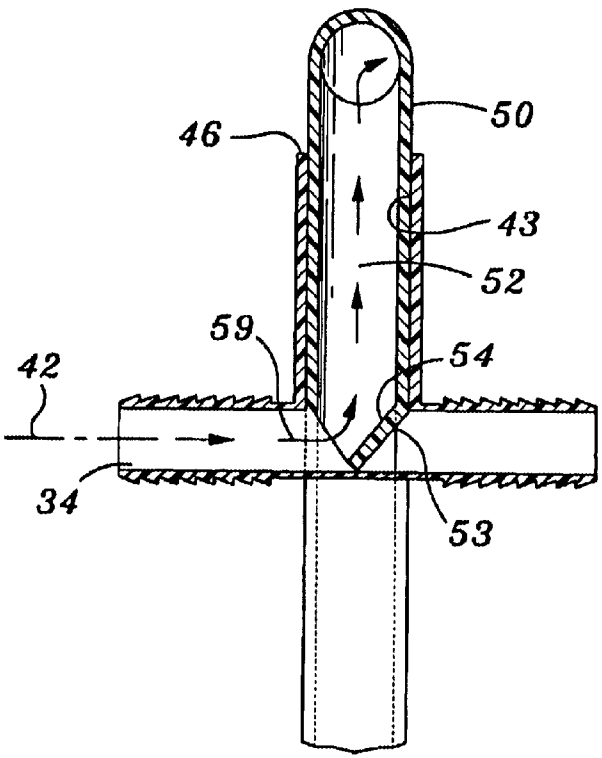
FIG. 6 is a fragmentary cross-section taken at line 6—6 in FIG. 5.
Figure 5:
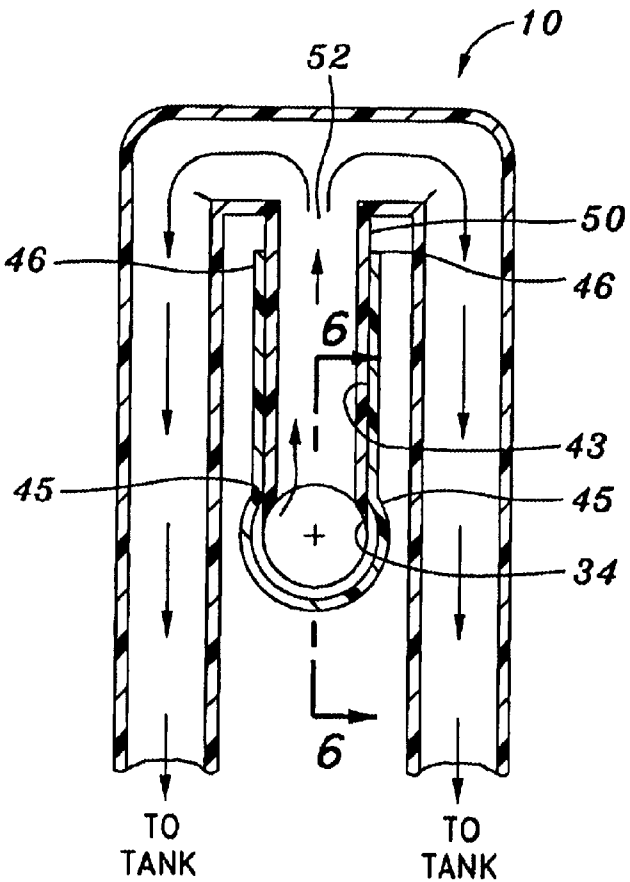
FIG. 5 is a fragmentary cross-section taken at line 5—5 in FIG. 3.

The plunger has a central passage 52 from end to end. At its lower end it is modified to form a deflector 53. The deflector is a surface 54 formed at an angle relative to both of the axes. It will deflect incoming water from the through passage into the plunger passage. As best shown in FIG. 6, the deflector will substantially fill and obstruct the lumen 51 downstream from the guide cylinder, so as to deflect substantially all of the water (except for leakage) into the plunger passage when the plunger is in its lower most position (FIGS. 3–6). When the plunger is lifted sufficiently, it will not occlude the flow passage. Then the deflector itself will block flow of water upwardly into. the plunger. Thus, this is a selector valve dependent on the position of the plunger.

A pair of tank discharge tubes 55, 56 are placed one on each side of the cylinder, and are fluidly connected to each other by a bridge pipe 57. The bridge pipe structurally connects the plunger and the tubes, and receives water from the plunger passage to be supplied to the discharge tubes. Accordingly, this arrangement makes the plunger and cylinder into a trombone style valve. A float 58 is attached to the two discharge tubes, such as by passing the tubes through holes in the float. The float may be a lightweight foam. It can be slided along the tubes for adjustment purposes.

It should be observed that when water is discharged under pressure from the tank valve against the surface of the diverter and the diverter is diverting the stream, there will be a binding force (arrow 59 in FIG. 6) of the plunger against the cylinder holding the plunger against raising, and a downward component of force also holding the plunger down. These forces are sufficient to hold the plunger in the lower position whatever the level of the water in the tank, but only while the water is flowing. When the water is "off", the force disappears, and the float can then control the elevation of the plunger.

Figure 1:
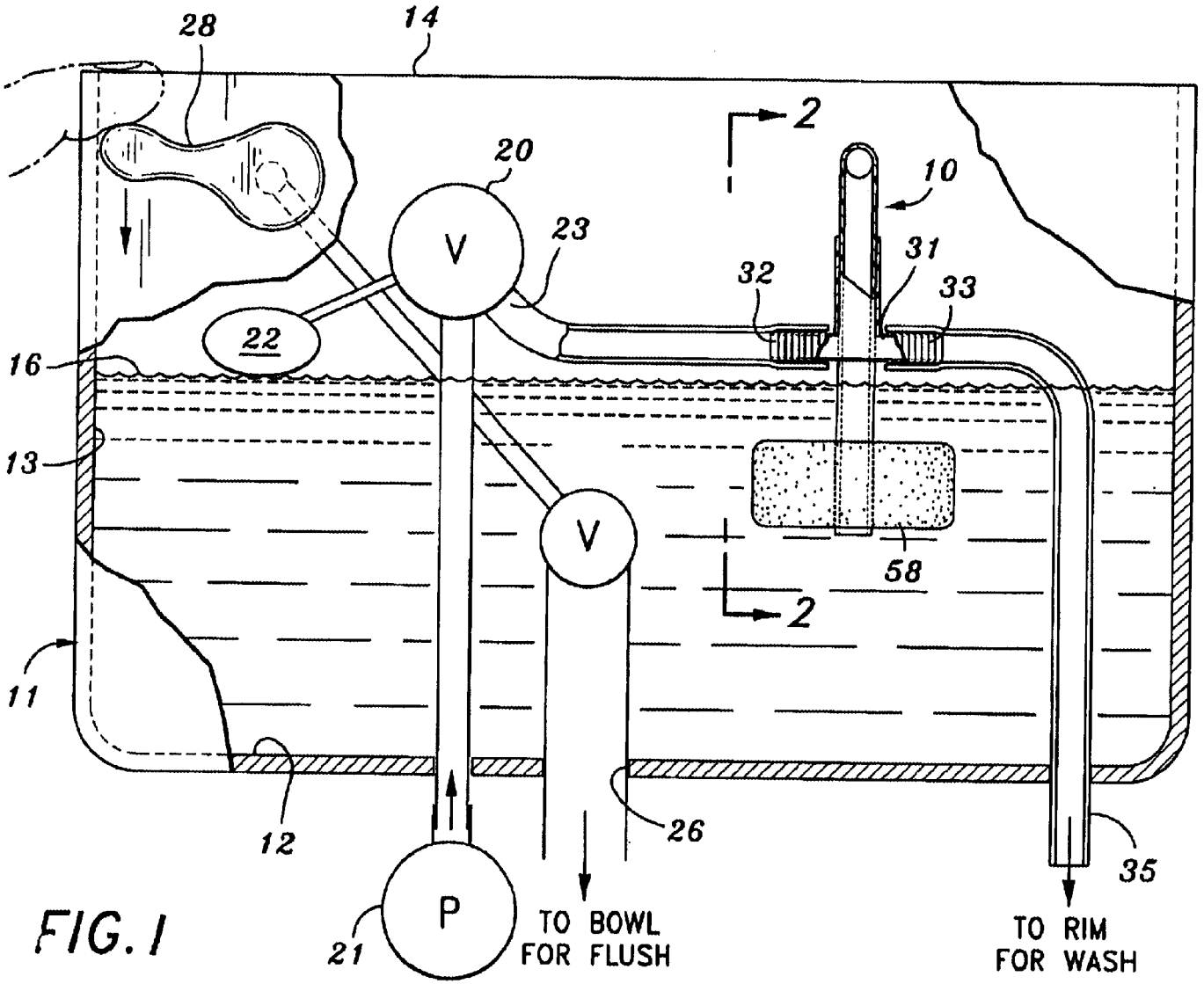
FIG. 1 is a side elevation, partly in cutaway cross-section and partly in schematic notation, showing the system of the invention in its repose condition.
Figure 4:
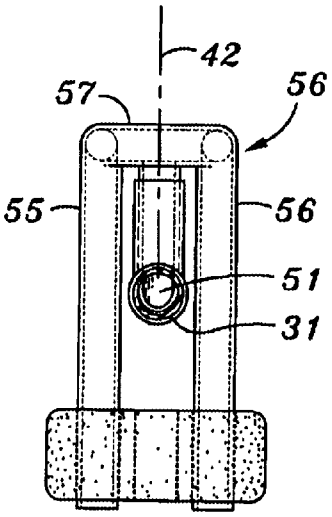
FIG. 4 is a cross-section taken at line 4—4 in FIG. 3.

The sequence of events begins with the repose condition shown in FIG. 1. The tank valve and flush valve are both closed. The float is submerged and has raised to move discharge tubes and plunger to their upper position. As shown in FIG. 2, the lumen is open to free flow, but is empty because the tank valve is off, and the lines from the tank valve have drained. The water in the tank is at storage level.

The cycle is begun by opening the flush valve. This permits stored water to flow out of the discharge port directly to the bowl. Also, the consequent lowering of the water lever lowers the tank valve float and opens it.

Here it will be observed that the diverter valve float 58 is still below the lowering water surface, and for the moment holds the plunger up as high as it will go. As a consequence, all water from the tank valve flows through the lumen directly to line 35 and to the rim of the bowl without diversion. At this time, no supplementary water goes into the tank- it is all through the lumen to the rim.

This condition prevails until the water level has fallen to a suitably lower level. Then the float may be out of the water, or supported in water at a lower elevation. This will move the discharge tubes and the plunger down so the diverter surface occludes the lumen. This level can be selected by appropriately placing the float 58 along the discharge tubes. Now the water from the tank valve flows through the plunger, into the discharge tubes, and into the tank. This is the source of refill water, after the flush valve closes, and for supplementary water before the flush valve closes, but no more water will flow to the rim.

The tank valve will stay open until the water level rises to the storage level. If the diverter were to remain in its previous position, then the tank could not refill—all water would again go to the bowl.

To prevent this, the physical force of the diverter water against the plunger will hold it in the lower position, and will keep it there regardless of the elevation of the diverter float, so long as the water flows from the tank valve. When the storage level is reached, the tank valve closes, water stops, forces 59 cease and the float can buoyantly raise the discharge tubes and the plunger. The system thus assumes its repose condition.

This diverter is a simple trombone style valve with provisions for a dynamic intervention in the movement of a buoyant float. It is simple, inexpensive, and reliable, and provides an improved wash and flush cycle.

It will be observed that the total upward and downward movement of the float, discharge tubes, bridge conduit and plunger can be rather short. The upward movement need only be enough to move the plunger out of the lumen, and the lower limit is where the plunger rests on the bottom of the through passage. Thus only an inch or so is necessary. The water level at which the plunger can move down is determined by the location of the float along the discharge tubes. The float will keep the plunger up until the water level falls to the elevation where the float will lower the deflector into the lumen. The float can even hang up at lower water levels.

This invention is not to be limited by the embodiment shown in the drawings and described in the description, which is given by way of example and not of limitation, but only in accordance with the scope of the appended claims.

I claim:

1. In combination;

a water storage tank having a bottom, a discharge port in said bottom, and a peripheral sidewall adapted to store water at least to an upper storage level and to enable discharge of water through the discharge port to a lower level;

a tank valve mounted to said tank having an inlet port an outlet port, and valve workings between said inlet and outlet ports to pass water under pressure when the ballcock valve is open, and a float responsive to water level to control said valve workings;

a flush valve in said discharge port adapted selectively to close said discharge port to store water, and to open to release it in a flush operation, and an actuator operable to open said tank valve;

a diverter valve comprising a base with a through passage extending from an inlet port to an outlet port having an axis and a lumen;

a guide cylinder extending from said base with a central axis normal to the axis of the through passage having a cylindrical wall that intersects and opens into said through passage at said lumen;

a tubular diverter plunger axially slidable in said cylinder, said diverter plunger having a central passage extending from end to end;

a deflector surface on the end of said diverter plunger closest to said through passage so proportioned that when the diverter plunger is in its lowermost position it substantially occludes the lumen and deflects water upwardly into the central passage, and when the diverter plunger is sufficiently raised, the deflector is removed from said lumen;

a pair of tank discharge tubes, one on each side of said plunger, a bridge conduit structurally joining and fluidly interconnecting said plunger with said discharge tubes;

a float adjustably attached along both of said discharge tubes, whereby said float, discharge tubes, plunger and bridge conduit move vertically in unison for selecting different water levels, said float thereby biasing the diverter plunger upwardly and opening the through passage to flow when the water level in said tank is sufficiently high, the reaction between the deflector surface and flow of water from the ballcock valve holds the diverter plunger down with the deflector surface in the lumen during the time while the float is at a lower level and the ballcock valve is open; and a conduit from the outlet port of the diverter valve for conveying water to the toilet rim.

2. A combination according to claim 1 in which said discharge tubes extend substantially parallel to said diverter plunger to discharge water into said tank, said discharge tubes extend to a level below said base, said float being attached to said discharge tubes.

3. A diverter valve receptive of water under pressure from a ballcock valve selectively to direct said water either to a water storage tank in which it is situated or to a conduit leading to the rim of a toilet, said diverter valve comprising:

a base with a through passage extending from an inlet port to an outlet port having an axis and a lumen;

a guide cylinder extending from said base with a central axis normal to the axis of the through passage having a cylindrical wall that intersects and opens into said through passage at said lumen;

a tubular diverter plunger axially slidable in said cylinder, said diverter plunger having a central passage extending from end to end;

a deflector surface on the end of said diverter plunger closet to said through passage so proportioned that when the diverter plunger is in its lowermost position it substantially occludes the lumen and deflects water upwardly into the central passage, and when the diverter plunger is sufficiently raised, the deflector is removed from said lumen;

a pair of tank discharge tubes one on each side of said plunger, a bridge conduit structurally joining and fluidly interconnecting to said plunger with said discharge tubes to form a trombone shape;

a float adjustably attached along both of said discharge tubes, whereby said float, discharge tubes, plunger and bridge conduit move vertically in unison, and so the float can be adjustably moved along said tubes to select different water levels, said float biasing the diverter plunger upwardly and opening the through passage to flow when the water level in said tank is sufficiently high, the reaction between the diverter surface and flow of water from the ballcock valve holds the diverter plunger down with the deflector in the lumen during the time while the float is at a lower level and the ballcock valve is open; and a conduit from the outlet port of the diverter valve for conveying water to the toilet rim.

4. A diverter valve according to claim 3 in which said discharge tube extends substantially parallel to said diverter plunger to discharge water into said tank, said discharge tubes extending to a level below said base.

* * * * *